US008128195B2

(12) United States Patent
Hendricks et al.

(10) Patent No.: US 8,128,195 B2
(45) Date of Patent: Mar. 6, 2012

(54) CROSS-WIPE CLEANING OF PAGE-WIDE ARRAY PRINTING

(75) Inventors: Jeffrey T Hendricks, Camas, WA (US); Gene D Jones, Yacolt, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 493 days.

(21) Appl. No.: 12/353,380

(22) Filed: Jan. 14, 2009

(65) Prior Publication Data

US 2010/0177141 A1 Jul. 15, 2010

(51) Int. Cl.
*B41J 2/165* (2006.01)

(52) U.S. Cl. ..... 347/33; 347/42

(58) Field of Classification Search ..... 347/33, 347/42

See application file for complete search history.

(56) References Cited

U.S. PATENT DOCUMENTS 4,829,318 A * 5/1989 Racicot et al. ..... 347/33
5,880,755 A * 3/1999 Fajour et al. ..... 347/33
6,340,219 B1 * 1/2002 Kumagai et al. ..... 347/33
6,523,930 B2 * 2/2003 Griffin et al. ..... 347/28
6,592,200 B2 * 7/2003 Wotton et al. ..... 347/22
6,648,450 B2 * 11/2003 Takahashi ..... 347/33
7,334,862 B2 * 2/2008 Kachi ..... 347/22
7,556,342 B2 * 7/2009 Hamano ..... 347/33
7,770,518 B2 * 8/2010 Barinaga et al. ..... 101/425
7,857,418 B2 * 12/2010 Matsuhashi et al. ..... 347/32
7,909,431 B2 * 3/2011 Taira ..... 347/33
2002/0163553 A1 * 11/2002 Takahashi ..... 347/33
2004/0061735 A1 * 4/2004 Balcan et al. ..... 347/22
2008/0231656 A1 * 9/2008 Kim ..... 347/33
2009/0027445 A1 * 1/2009 Chikamoto ..... 347/29

* cited by examiner

*Primary Examiner* — Charlie Peng
(74) *Attorney, Agent, or Firm* — Scott Gallert

(57) ABSTRACT

Methods and means for wiping a page-wide print array are provided. An installable and removable cartridge includes a quantity of web material. The web material traverses a serpentine pathway and is driven by a motor such that fresh web material can be provided to a cleaning zone. The web material within the cleaning zone is wiped across the ink discharge surface of an array of printing dies to remove debris. Wiping action is performed perpendicular to a lengthwise aspect of the page-wide print array. Various embodiments of compact and effective cleaning mechanisms are thus provided in modular, replaceable forms.

11 Claims, 5 Drawing Sheets

CROSS-WIPE CLEANING OF PAGE-WIDE ARRAY PRINTING

BACKGROUND

Page-wide array printing uses a plurality of fixed (i.e., stationary), ink jetting dies to simultaneously form images across a width-wise aspect of a moving sheet media such as paper, etc. Typically, each of the dies includes numerous rows of nozzles configured to controllably discharge ink, wherein each row of nozzles is used to apply a particular color.

Ink residue, paper dust and other debris accumulate on the ink discharge surfaces of the dies during normal operation, necessitating cleaning or else print quality will eventually degrade. However, the present design trend is toward progressively smaller equipment footprints and chassis volumes. Consequently, designers seek means to facilitate automated printer cleaning using more compact topologies.

Accordingly, the embodiments described hereinafter were developed in light of the foregoing and other drawbacks associated with the cleaning of page-wide array printing mechanisms.

BRIEF DESCRIPTION OF THE DRAWINGS

The present embodiments will now be described, by way of example, with reference to the accompanying drawings, in which.

DETAILED DESCRIPTION

Introduction

Methods and means for cleaning page-wide print arrays using a compact web wipe cartridge or mechanical assembly are provided.

In one embodiment, a method is provided that includes wiping an ink discharge surface of at least one printing die in a direction of motion perpendicular to a lengthwise aspect of at least one printing die.

In another embodiment, an apparatus includes a web wipe material and a tongue. The tongue is configured to support at least a portion of the web wipe material. The apparatus is configured to cross-wipe an ink discharge surface of at least one printing die using the web wipe material.

In yet another embodiment, a device includes a plurality of printing dies arranged as a page-wide print array. The device also includes a web wipe assembly including a web material. The web wipe assembly is configured to clean an ink discharge surface of the page-wide print array using a cross-wiping motion of the web material.

First Illustrative Embodiment

Figure 1:
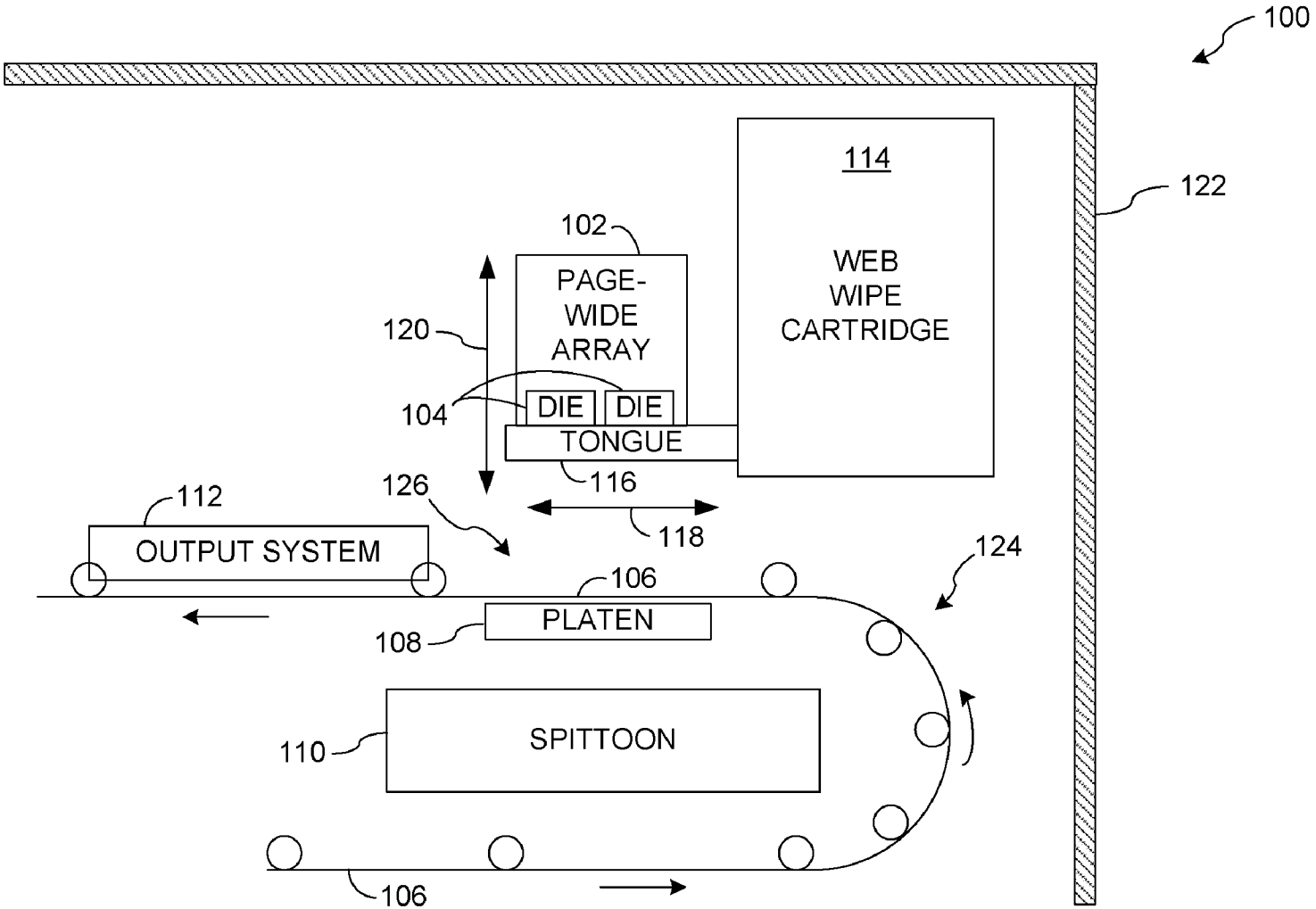
FIG. 1 depicts a block diagrammatic view of a printer according to one embodiment.

FIG. 1 depicts a printer 100 according to one embodiment. The printer 100 is illustrative and non-limiting with respect to the present teachings. Thus, any practical number of other embodiments of printer, web printing system, etc., can be defined and used in accordance with the present teachings.

The printer 100 includes a page-wide print array (array) 102. The array 102 is illustrative and non-limiting in nature. The array 102 includes a plurality of printing dies 104. While only two printing dies 104 are depicted in FIG. 1, it is to be understood that any suitable number of dies 104 can be used. The dies 104 are typically arranged in staggered adjacency so as to enable simultaneous imaging (i.e., printing) across a width-wise aspect of a sheet media 106 such as paper, etc. The printing dies 104 are configured to apply one or more colored inks to sheet media 106 so as to form imaging (e.g., text, numerals, indicia, symbols, photographic images, etc.) thereon.

The printer 100 also includes a platen 108 configured to support the sheet media 106 as needed during imaging on the media by the array 102. Additionally, the printer 100 includes a spittoon 110 configured to capture any ink not incident to the surface of the sheet media 106. The spittoon 110 can be of any suitable size, shape and material as needed to protect other aspects of the printer 100 from ink overspray.

The printer 100 further includes an output system 112. The output system 112 is configured to perform one or more post-imaging operations such as, for example, drying the media 106, cutting the media 106 into numerous discrete pieces, etc. The output system 112 can be defined by any suitable post-printing processing system or apparatus as desired in accordance with the present teachings.

The printer 100 also includes a web wipe cartridge (cartridge) 114. The cartridge 114 is configured to perform a cleaning operation on the printing dies 104 of the array 102. According to the present teachings, the cartridge 114 has a tongue portion 116 configured to be selectively extended and retracted relative to the balance of the cartridge 114 as indicated by the double-arrow 118. In turn, the page-wide print array 102 can be selectively translated as indicated by the double-arrow 120. The cartridge 114 has a relatively compact form and is configured to fit within a housing 122 of the printer 100. Further details of an illustrative and non-limiting cartridge according to the present teachings are provided hereinafter.

The printer 100 can also include other resources and mechanisms not specifically shown in FIG. 1. Such illustrative and non-limiting resources can include, for example, a power supply, one or more supplies of ink, one or more motors, an operator interface, input/output circuitry, data storage, network communication circuitry, wireless communications capabilities, media handling mechanisms, etc. The printer 100 is further understood to include a controller and/or control system configured to control normal operations of the printer 100 in accordance with the present teachings.

During typical operation of the printer 100, the sheet media 106 is guided (i.e., transported or propelled) along a curvilinear pathway 124 and over the platen 108. The region or space immediately above the platen 108 is referred to herein as the "print zone" 126, as this where the dies 104 are positioned during the application of ink(s) to the sheet media 106. Recall that the array 102 can be translated in either direction 120 and held fast in one or more positions. In any case, the array 102 applies one or more colors of ink to the media 106 within the print zone 126 so as to form images thereon (e.g., indicia, text, photographs, etc.).

Eventually, sufficient ink residue, paper dust and/or other contaminants accumulate on the discharge surface of the dies 104 such that the page-wide print array 102 must be cleaned.

Any printing operation that is in progress is now halted and the array 102 is moved away from the print zone 126 to an upward, pre-wipe position.

The tongue 116 of the cartridge 114 is next extended until a web material (not shown) of the cartridge 114 is brought into contact with the array 102. Further extension of the tongue 116 results in wiping the web material across the dies 104 in the direction(s) 118 such that the ink discharge surface of the array 102 is cleaned of debris. The wiping action of the tongue 116 can be optionally performed in either direction or both as indicated by double-arrow 118. Furthermore, repeated wiping passes of the tongue 116 can be performed in an oscillatory manner so as to achieve sufficient cleaning of the dies 104 of the array 102. In any case, such wiping is performed in a direction that is perpendicular to a lengthwise aspect of the page-wide print array 102. This perpendicular wiping action is referred to herein as "cross-wiping".

Once the wiping action is performed, the tongue 116 is retracted (partially or fully) back into the cartridge 114. Thereafter, the array 102 is lowered back into the print zone 126. Normal printing of the media 106 can then resume. The printer 100 and in particular the cartridge 114 are illustrative and non-limiting with respect to the present teachings. Other embodiments of printer and/or web wipe cartridge and/or wiping mechanism, can also be configured and used in accordance with the present teachings.

Second Illustrative Embodiment

Figure 2A:
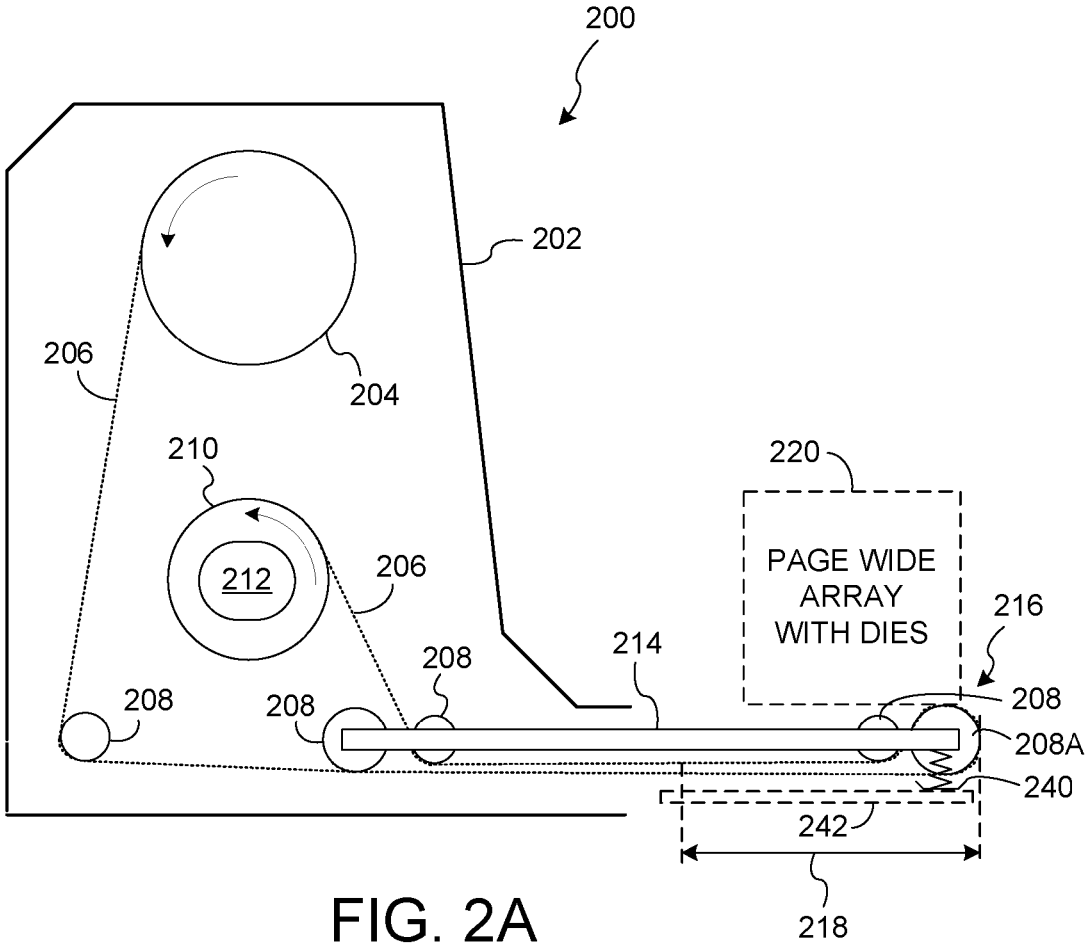
FIG. 2A depicts a schematic elevation view of a web wipe cartridge according to another embodiment.

FIG. 2A is a schematic elevation view depicting a web wipe cartridge (cartridge) 200 according to one embodiment. The cartridge 200 is illustrative and non-limiting. Thus, any number of other embodiments of web wipe cartridge can be defined and used according to the present teachings.

The cartridge 200 includes a housing 202 configured to support numerous components and resources that are respectively described hereinafter. The housing 202 is configured such that the cartridge 200 is installable in and removable from a printer or printing system (not shown in FIG. 2) in a modular manner by a user.

The cartridge 200 also includes a supply spool 204. The supply spool 204 is configured to support a portion of a web material 206 in a roll form. The web material 206 can be defined by any suitable, absorbent material such as cotton fabric, woolen or synthetic felt, nylon, or any other suitable, generally soft material selected so as to make non-damaging wiping contact with printing dies. The web material 206 is provided in a flexible strip form and is routed and supported by guide rollers 208 of the cartridge 200 under a suitable amount of tension. The portion of the web material 206 supported by the supply spool 204 not yet been used in a cleaning operation and is therefore referred to as unused or "fresh" in condition. The web material 206 is defined by a width that is equal to, or greater than, a lengthwise (i.e., printable width) aspect of a page-wide print array 220 to be cleaned.

The cartridge 200 also includes numerous guide rollers 208 configured to support and guide the web material 206 along a defined pathway in a belt-like manner. The cartridge 200 further includes a take-up spool 210. The take-up spool 210 is configured to collect the used (i.e., post-cleaning) portion of the web material 206 in a roll form. The cartridge 200 also includes a motor 212 that is mechanically coupled and configured to rotationally drive the take-up spool 210 in the direction indicated. In this way, the motor 212 draws fresh web material 206 from the supply spool 204, which traverses the pathway defined by the rollers 208 and 208A, and is collected onto the take-up spool 210.

Still referring to FIG. 2A, the web wipe cartridge 200 also includes a tongue 214. The tongue 214 supports a number of the rollers 208 and a roller 208A such that the web material 206 is routed through a cleaning zone 216 at a distal end of the tongue 214. The roller 208A includes an elastomer coating or other compliant material so as to ensure good contact with a printing die surface to be cleaned. The tongue 214 includes a pair of spring-loaded sleds (sleds) 240 located proximate to the distal end of the tongue 214. Only one sled 240 is depicted for simplicity. Each sled 240 is configured to be slidably supported on a corresponding track (or rail) 242 of the printer (not shown) so as to support the distal end of the tongue 214 in operative contact with a page-wide array 220 during cleaning operations.

The tongue 214 is further configured so as to be selectively extended and retracted over a range of motion 218. In one embodiment, the motor 212 is configured in cooperation with a mechanical coupling (not shown) so as to drive the extension and retraction of the tongue 214. Other embodiments can also be used. In any case, the cartridge 200 is configured to perform cross-wipe cleaning operations on a page-wide print array 220.

First Illustrative Operation

Figure 2B:
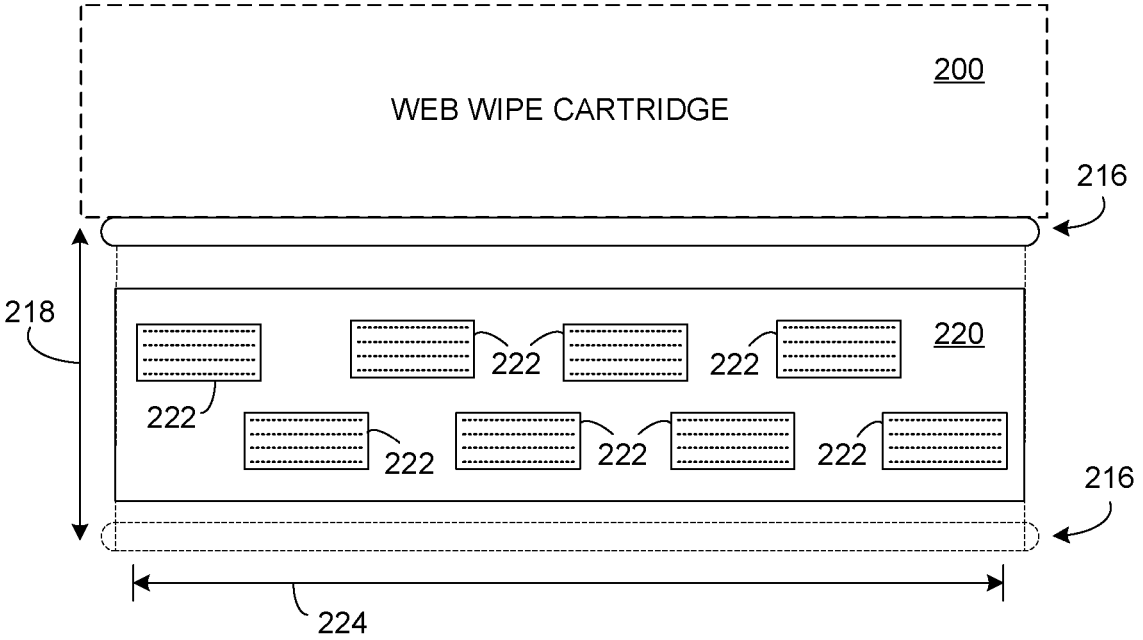
FIG. 2B depicts a schematic plan view of the web wipe cartridge of FIG. 2A.

FIG. 2B is a schematic plan view depicting cross-wiping operation of the web wipe cartridge (cartridge) 200 according to one embodiment. The perspective depicted in FIG. 2B is looking into the ink discharge surface of the page-wide print array 220. The ink discharge surface is typically, but not necessarily, directed downward with respect to gravity. Reference is now made to FIGS. 2A and 2B, respectively. The page-wide print array (array) 220 includes a plurality of printing dies 222. The dies 222 are arranged in a staggered configuration so as to collectively enable simultaneous imaging across the width of a printable media (e.g., paper, etc.). Furthermore, the dies 222 include respective rows of nozzles arranged along (i.e., parallel to) a lengthwise aspect (i.e., printable width) 224 of the array 220. Thus, each of the dies 222 can also be considered as having a lengthwise aspect parallel to the lengthwise aspect 224 of the page-wide print array 220.

The tongue 214 of the cartridge 200 is extendable over the range 218. Also, the cleaning zone 216, including roller 208A, extends (at least) over the entire lengthwise aspect 224 of the array 220. In this way, the web material 206 makes cleaning contact with all of the dies 222 during a complete cross-wiping operation. Cross-wiping can be performed in just one direction, or the other direction, or in both directions 218. Furthermore, cross-wiping can be performed in a single pass or in a repeated, oscillatory action. Additionally, the web material 206 can be optionally transported by way of motor 212 such that fresh wipe material 206 is drawn into the print zone 216 during some or all of the cross-wiping operation. Thereafter, the tongue 214 is retracted back toward the cartridge 200 so that printing operations using the array 220 can eventually resume.

In another embodiment (not shown), a tongue portion does not extend or retract relative to the balance of a web wipe cartridge or assembly. Rather, the entire cartridge itself, including the tongue portion, is moved relative to a page-wide print array so as to effect cross wipe cleaning of the printing dies. In yet another embodiment, the tongue portion can be extended such that array 220 can eject or "spit" ink onto that portion of the web material 206 that is supported approximately mid-way along the tongue 214 in order to perform a printing die clearing operation. In this way, such a cartridge provides service in at least two cleaning modes (i.e., cross-wiping and die spitting).

It is important to note that no specific configuration and/or constituency of a web wipe cartridge, or any other mechanism having a web material, is required for successful cross-wiping operation in accordance with the present teachings. Rather, the present teachings are directed to cleaning an array of printing dies using at least one contacting motion performed along a line of operation that is perpendicular to a lengthwise (i.e., media width) aspect of the print array. Furthermore, the present teachings are directed toward simultaneously cleaning the entire lengthwise aspect of the page-wide print array during the cross-wipe operation. Numerous means and respective configurations can be used according to the present teachings.

First Illustrative Method

Figure 3:
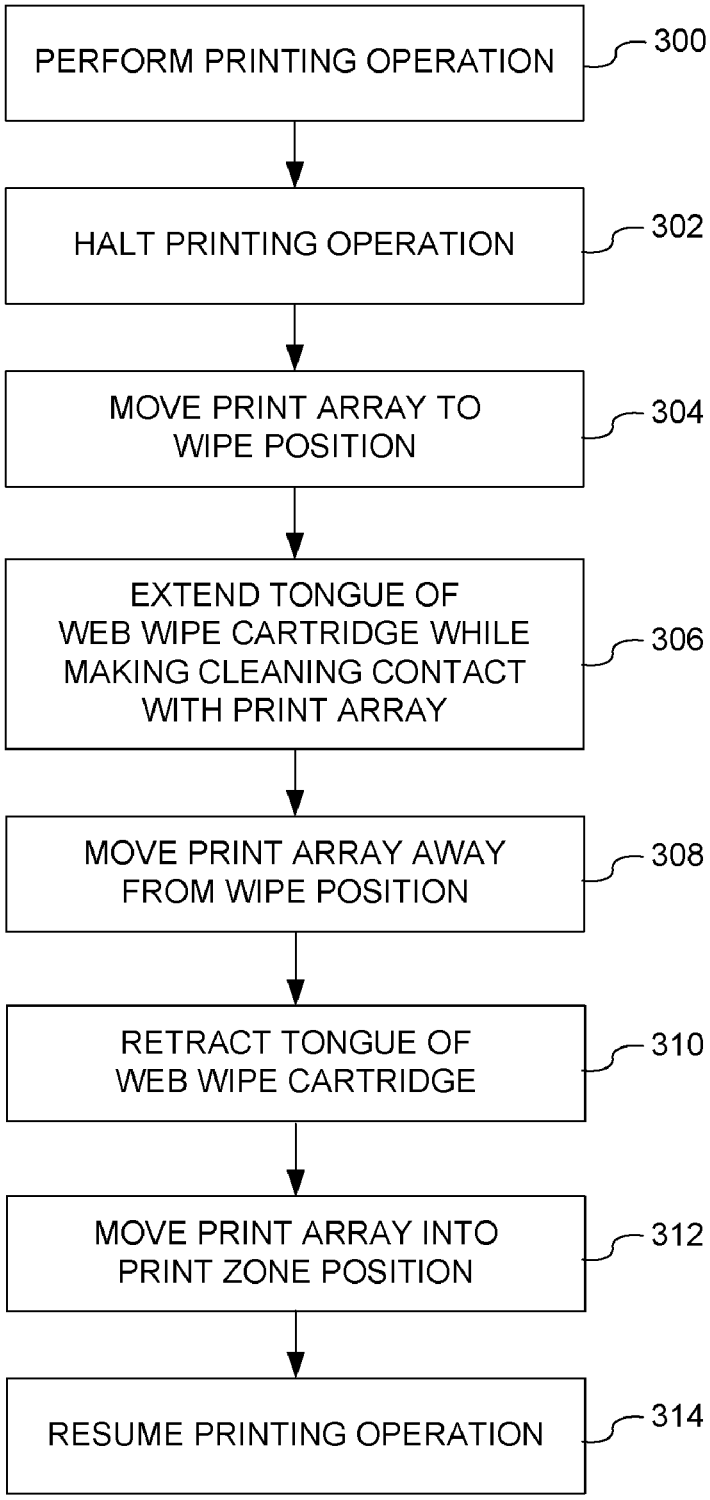
FIG. 3 depicts a method of cross-wiping according to one embodiment.

FIG. 3 is a flow diagram depicting a method in accordance with one embodiment. The flow diagram of FIG. 3 depicts particular method aspects and order of execution. However, it is to be understood that other methods including and/or omitting certain details, and/or proceeding in other orders of execution, can also be used without departing from the scope of the present teachings. Therefore, the method of FIG. 3 is illustrative and non-limiting in nature.

At 300, a printer having a page-wide print array of printing dies is operating so as to form images (e.g., text, numerals, indicia, photographs, etc.) on a moving sheet media (e.g., paper, etc.).

At 302, the printing operation is suspended and the moving sheet media is brought to a stop.

At 304, the page-wide print array is moved away from the printing position and into a wipe (or cleaning) position.

At 306, a tongue of a web wipe cartridge is extended until contact is established between a web material and the ink discharge surface (i.e., die side) of the page-wide print array. The tongue is further extended while the web material makes cross-wiping contact with the print array, cleaning debris from the dies. A compliant aspect of the roller supporting the web material functions to ensure complete contact with the dies being cleaning. In one embodiment, the web material can be continuously advanced during the cross-wiping motion such that clean, unused web material is being supplied to the cleaning zone. In any case, a single cross-wiping stroke over the surface of the page-wide print array is performed.

At 308, the page-wide print array is moved away from the cleaning position and into a post-wipe (or hold) position.

At 310, the tongue of the web wipe cartridge is retracted back toward the cartridge and away from the space where the cross-wipe cleaning was just performed.

At 312, the page-wide print array is moved back into the printing position away from the post-wipe position.

At 314, normal printing operations are resumed using the just cleaned page-wide print array.

The method of FIG. 3 is illustrative of just one of any number of cross-wipe cleaning operations that can be performed, wherein a single pass or wipe of the web material over the printing die surfaces is used per cleaning operation. Other methods can be used, as can various embodiments for performing such methods according to the present teachings.

Second Illustrative Method

Figure 4:
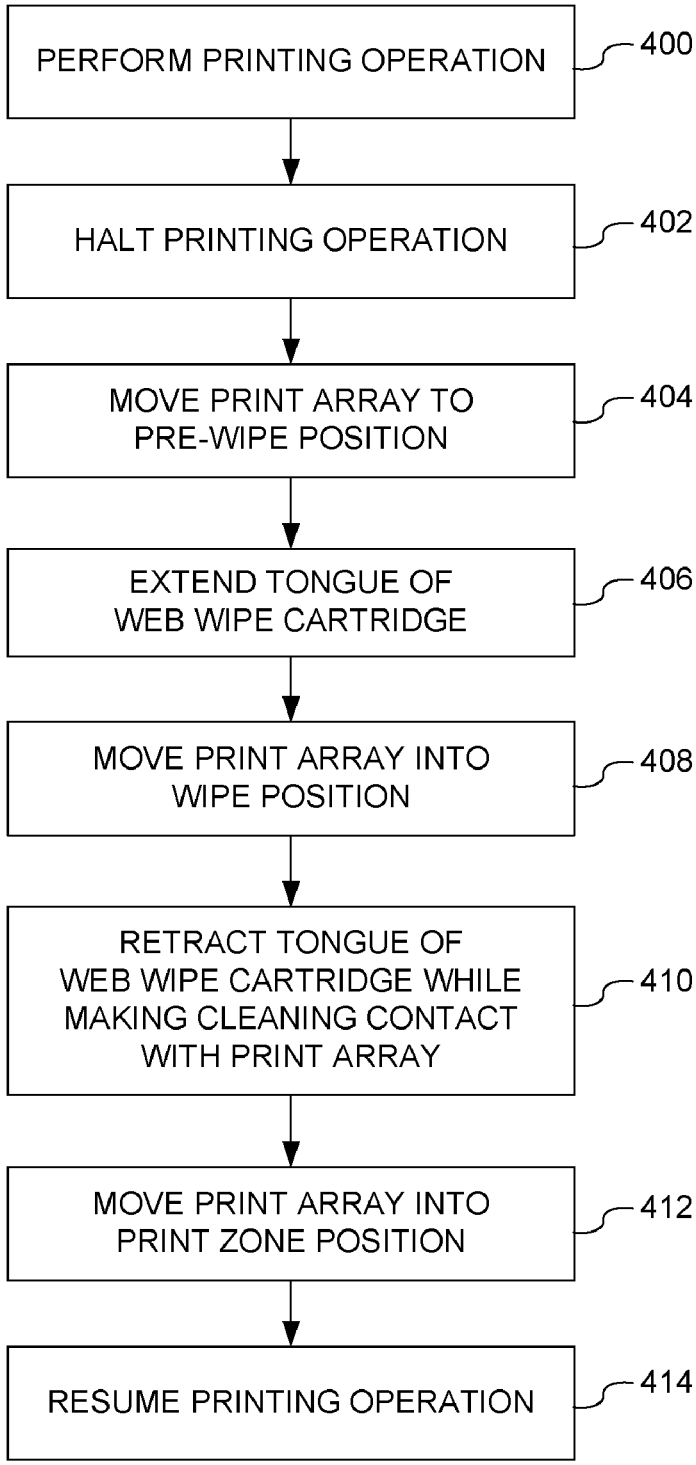
FIG. 4 depicts a method of cross-wiping according to another embodiment.

FIG. 4 is a flow diagram depicting a method in accordance with one embodiment. The flow diagram of FIG. 4 depicts particular method aspects and order of execution. However, it is to be understood that other methods including and/or omitting certain details, and/or proceeding in other orders of execution, can also be used without departing from the scope of the present teachings. Therefore, the method of FIG. 4 is illustrative and non-limiting in nature.

At 400, a printer having a page-wide print array of printing dies is operating so as to form images (e.g., text, indicia, photographs, etc.) on a moving sheet media.

At 402, the printing operation is halted and the moving sheet media is brought to a stop.

At 404, the page-wide print array is moved away from the printing position and into a pre-wipe (or waiting) position.

At 406, a tongue of a web wipe cartridge is extended to a fully distal, pre-operating condition. No contact with the page-wide print array is made during the extension of the tongue.

At 408, the page-wide print array is moved to a wipe (or cleaning) position in contact with a web material supported by the web wipe cartridge.

At 410, the tongue is retracted back toward the web wipe cartridge while the web material makes cross-wiping contact with the print array, thus cleaning debris from the dies. In one embodiment, the web material is continuously refreshed with clean, unused web material during the cross-wiping motion. In any case, a single cross-wiping stroke over the surface of the page-wide print array is performed.

At 412, the page-wide print array is moved back into the printing position from the wipe (or cleaning) position.

At 414, normal printing operations are resumed using the just cleaned page-wide print array.

The method of FIG. 4 is illustrative of another cross-wipe cleaning operation wherein a single wipe of the web material over the printing die surfaces is used. Other single-wipe methods can be used, as can various embodiments for performing such methods, in accordance with the present teachings.

Third Illustrative Method

Figure 5:
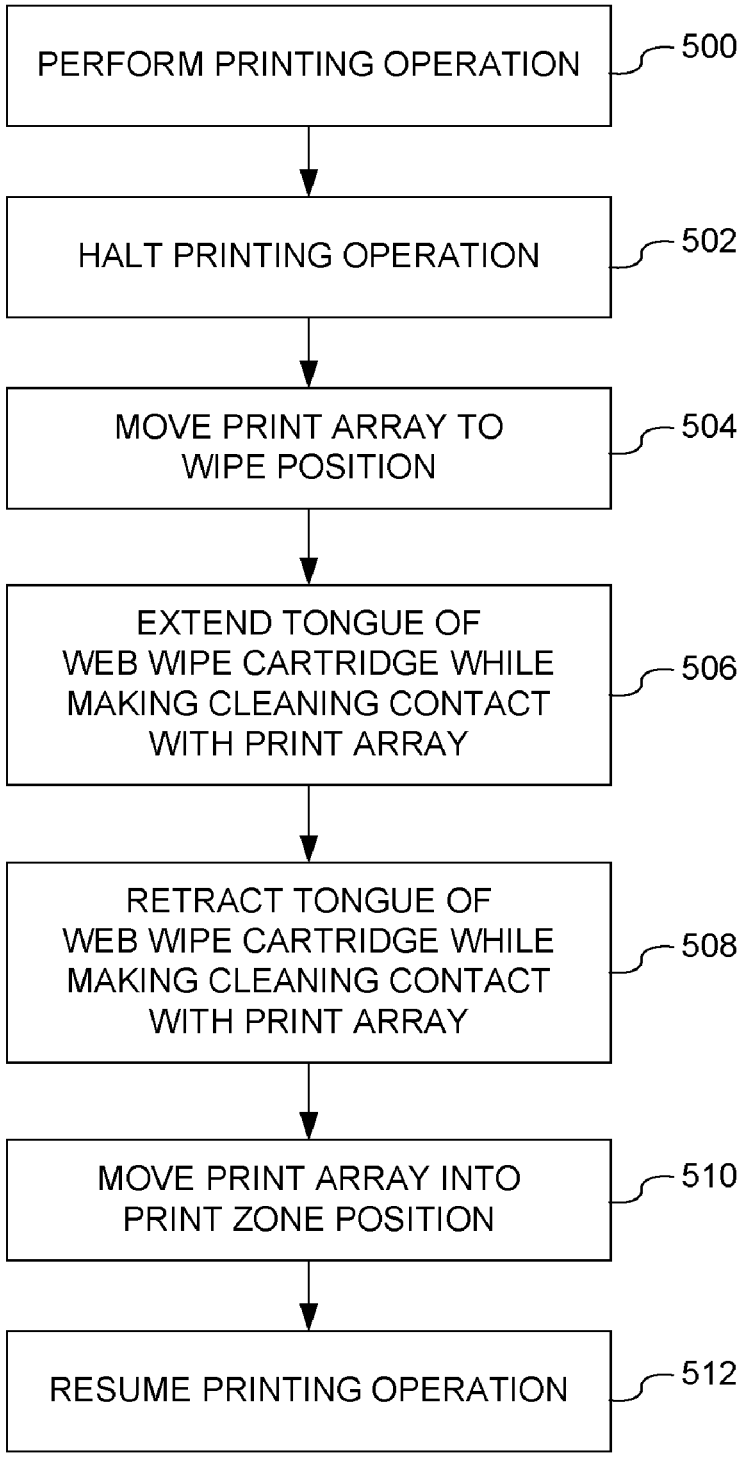
FIG. 5 depicts a method of cross-wiping according to yet another embodiment.

FIG. 5 is a flow diagram depicting a method in accordance with one embodiment. The flow diagram of FIG. 5 depicts particular method aspects and order of execution. However, it is to be understood that other methods including and/or omitting certain details, and/or proceeding in other orders of execution, can also be used without departing from the scope of the present teachings. Therefore, the method of FIG. 5 is illustrative and non-limiting in nature.

At 500, a printer having a page-wide print array of printing dies is operating so as to form images (e.g., text, indicia, etc.) on a moving sheet media.

At 502, the printing operation is halted and the moving sheet media is brought to a stop.

At 504, the page-wide print array is moved away from the printing position and into a wipe (or cleaning) position.

At 506, a tongue of a web wipe cartridge is extended until contact is established between a web material and the ink discharge surface (i.e., die side) of the page-wide print array. The tongue is further extended while the web material makes cross-wiping contact with the print array, cleaning debris from the dies. In one embodiment, the web material is continuously refreshed with clean, unused web material during the cross-wiping motion.

At 508, the tongue is retracted back toward the web wipe cartridge while the web material makes cross-wiping contact with the print array so as to clean any additional debris from the printing dies. In one embodiment, the web material is continuously refreshed during the cross-wiping motion. The tongue continues to be retracted until it is back in a pre-use condition, away from the page-wide print array.

At 510, the page-wide print array is moved back into the printing position from the wipe (or cleaning) position.

At 512, normal printing operations are resumed using the just-cleaned page-wide print array.

The method of FIG. 5 is illustrative of yet another cross-wipe cleaning operation wherein a two wipes (i.e., extend and retract) of the web material over the printing die surfaces are used. In another method, a period of repeated, oscillatory wiping of the page-wide print array can be used in accord with the present teachings. Other multiple-wipe methods can also be used, as can various embodiments for performing such methods.

In general, the foregoing description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

What is claimed is:

1. A method comprising:

first-wiping an ink discharge surface of a plurality of printing dies arranged as a page-wide print array in a first direction of motion perpendicular to a lengthwise aspect of the page-wide print array, by movably extending a tongue outward from a web wipe cartridge, where the first-wiping of the ink discharge surface occurs while the tongue moves outward from the web wipe cartridge; and second-wiping the ink discharge surface in a second direction of motion perpendicular to the lengthwise aspect of the page-wide print array and opposite the first direction of motion, by movably retracting the tongue inward into the web wipe cartridge, where the second-wiping of the ink discharge surface occurs while the tongue moves inwards into the wet wipe cartridge.

2. The method according to claim 1, the direction of motion being defined as a first direction of motion, the method further comprising wiping the ink discharge surface of the plurality of printing dies with the tongue by translating the tongue in a second direction of motion opposite to the first direction of motion and perpendicular to the lengthwise aspect of the page-wide print array.

3. The method according to claim 1, the wiping performed using a web material.

4. The method according to claim 3, the web material supported by a compliant roller of the a web wipe cartridge.

5. The method according to claim 1 further comprising at least:

moving the plurality of printing dies away from a print zone position prior to the wiping; or moving the plurality of printing dies into a print zone position after the wiping.

6. The method according to claim 1 further comprising applying at least one color of ink to a moving printable media using the page-wide print array after the wiping.

7. The method according to claim 1, wherein the tongue extends and retracts from the web wipe cartridge that is located adjacent the page-wide print array.

8. The method according to claim 1, wherein the web wipe cartridge is movable relative to the plurality of printing dies.

9. The method according to claim 1, at least one of the plurality of printing dies defined by one or more rows of nozzles arranged parallel to a lengthwise aspect of the at least one printing die.

10. A device, comprising:

a plurality of printing dies arranged as a page-wide print array; and a web wipe assembly including a web material and a tongue, the web wipe assembly to first-wipe and second-wipe an ink discharge surface of the page-wide print array, wherein the first-wipe is in a first direction of motion perpendicular to a lengthwise aspect of the page-wide print array, in which the tongue movably extends outward from the web wipe assembly, where the first-wiping of the ink discharge surface occurs while the tongue moves outward from the web wipe assembly, and wherein the second-wipe is in a second direction of motion perpendicular to the lengthwise aspect of the page-wide print array and opposite the first direction of motion, in which the tongue movably retracts inward into the web wipe assembly, where the second-wiping of the ink discharge surface occurs while the tongue moves inwards into the wet wipe assembly.

11. The device according to claim 10, the web wiping assembly further configured to transport the web material in a belt-like manner during the cleaning of the ink discharge surface of the page-wide print array.

* * * * *

UNITED STATES PATENT AND TRADEMARK OFFICE

CERTIFICATE OF CORRECTION

PATENT NO. : 8,128,195 B2
APPLICATION NO. : 12/353380
DATED : March 6, 2012
INVENTOR(S) : Jeffrey T Hendricks et al.

It is certified that error appears in the above-identified patent and that said Letters Patent is hereby corrected as shown below:

In column 7, line 33, in Claim 1, delete “wet” and insert -- web --, therefor.

In column 7, line 44, in Claim 4, after “the” delete “a”.

In column 8, line 38, in Claim 10, delete “wet” and insert -- web --, therefor.

Signed and Sealed this
Sixth Day of November, 2012

David J. Kappos

David J. Kappos
*Director of the United States Patent and Trademark Office*